United States Patent [19]

Ranger et al.

[11] 4,012,543

[45] Mar. 15, 1977

[54] COATED PAPER AND METHOD OF MAKING SAME

[75] Inventors: Howard Lee Ranger, West Buxton; Mahlon Randall Kirk, South Windham; Abbott Woodward Mosher, Gorham, all of Maine

[73] Assignee: Scott Paper Company, Philadelphia, Pa.

[22] Filed: Aug. 8, 1974

[21] Appl. No.: 495,808

Related U.S. Application Data

[63] Continuation of Ser. No. 39,849, May 22, 1970, abandoned, which is a continuation-in-part of Ser. No. 836,592, June 25, 1969, abandoned.

[52] U.S. Cl. ..... 427/361; 427/365; 427/366; 427/369; 427/370; 427/411

[51] Int. Cl.[2] ..... B44D 1/44

[58] Field of Search ..... 117/64 R, 64 C, 65.2, 117/60, 83, 155 R, 155 UA; 427/361, 365, 366, 369, 370, 411

[56] References Cited

UNITED STATES PATENTS

| | | | |
|---|---|---|---|
| 3,028,258 | 4/1962 | Rice | 117/83 |
| 3,268,354 | 8/1966 | Hain | 117/64 C |
| 3,296,014 | 1/1967 | Williams | 117/64 C |

*Primary Examiner*—Michael R. Lusignan
*Attorney, Agent, or Firm*—John A. Weygandt

[57] ABSTRACT

A coated paper having high gloss and high bulk and a method for producing the paper wherein a high-solids coating is applied to the paper and pressed against a heated finishing surface.

24 Claims, 4 Drawing Figures

COATED PAPER AND METHOD OF MAKING SAME

This is a continuation, of application Ser. 39,849, filed May 22, 1970, now abandoned, which in turn is a continuation-in-part of application Ser. No. 836,592, filed June 6, 1969, now abandoned.

BACKGROUND OF THE INVENTION

1. Field of the Invention

The present invention relates to a coated paper having high gloss and high bulk, and to a method of making said paper by coating and drum finishing the paper.

2. Description of the Prior Art

A method of finishing aqueous mineral coatings on paper is disclosed by Hart in U.S. Pat. No. 2,919,205 granted on Dec. 29, 1959 wherein the wet, coated web is pressed by an impervious backing means against a smooth heated surface having a temperature substantially above 100° C, the external pressure applied being greater than the pressure of steam at the temperature of said heated surface. The aqueous coating at the time of its contact with the hot roll is sufficiently coherent so that it is not disrupted by the evolution of steam when the heated web is exposed to atmospheric pressure upon leaving the pressure nip.

One application of the basic teachings of Hart is known in the paper-coating art as "gloss-calendering" which, for the purpose of the present application, involves the production of a glossy surface on paper or related web materials by contacting the surface of a coated substrate with a polished finishing surface under temperature conditions sufficient to cause a temporary condition of plasticity in the surface thereof and under pressure conditions sufficient to smooth, mold and polish the surface to thereby obtain a high degree of finish or gloss without unduly compacting the substrate. This higher bulk leads to increased brightness and opacity, which are desirable properties in coated printing papers.

Suitable apparatus for gloss-calendering coated paper and related materials is described in, for example, U.S. Pat. No. 3,124,480 granted Mar. 10, 1964 to Mahoney et al for "Hot Pressure Finishing Apparatus for Web Materials."

Throughout the history of the prior art, efforts have been made to employ gloss-calendering techniques to produce a finished paper of high gloss. The advantage of gloss-calendering over other finishing techniques, particularly supercalendering, is that gloss-calendering results in minimal compacting of the base sheet, while supercalendering decreases bulk and densifies the base sheet. Supercalendering is generally destructive to many properties of the paper and in particular decreases brightness, opacity and bulk.

While gloss-calendering enjoys some use at the present time, it has not been successfully employed on a commercial scale to produce glossy finishes on paper. The primary reason for this failure is believed to be the competing and relatively incompatible requirements that the paper coating be wet enough to be molded by the gloss-calendering roll and at the same time be dry enough that the coating does not stick to the gloss-calendering drum. If the coating adheres to the gloss-calendering drum, it will be stripped away from the paper substrate as the paper is removed from the drum at the nip, thereby ruining the product.

A method by which high-bulk coated paper is purportedly produced is disclosed by Hain in U.S. Pat. No. 3,268,354 granted in 1966 and in U.S. Pats. No. 3,338,735 and 3,338,736 granted in 1967. In accordance with the invention of Hain, there is provided coated paper comprising a fibrous cellulosic substrate having bonded thereto a film comprising a major weight proportion of finely divided solid filler and a minor weight proportion of thermoplastic resin. In accordance with the technique of Hain, the coating is applied to the substrate and dried by heating to form an exposed coating surface which is dry to the touch. This step of drying the coating before gloss-calendering is in accordance with the teachings of the prior art as represented, for example, by Rice in U.S. Pats. Nos. 3,028,258 granted 1962 and 3,281,267 granted 1966. The resultant coated substrate is then passed through a nip between a pair of turning rolls, one of which is provided with a heated finishing surface for contacting the exposed surface of the coating. Together the rolls apply sufficient heat and pressure to cause the resin particles to coalesce at least partially.

These prior art techniques have not met with commercial success for reasons which will become apparent hereinafter.

SUMMARY OF THE INVENTION

The present inventors have found that by taking a direction opposite to that taught by the prior art, a high-gloss, high-bulk coated paper can be produced at gloss-calendering speed without the necessity of appreciably drying the coating prior to gloss-calendering. The gloss-calendered surface of the coated paper product of the present invention has a gloss reading of at least 50 and preferably greater than 60, as measured at 75° in accordance with TAPPI T-480 ts-65. This high gloss paper is further characterized in having high bulk, i.e. density characteristic of lightly machine-calendered paper, although the coating itself is dense and provides excellent ink holdout.

In accordance with the method of the present invention, at the time of gloss-calendering, the coating is appreciably wet; in fact the moisture content of the coating layer is so high that it would readily stick to the surface of the gloss-calendering roll if an anti-sticking agent were not employed. In order to achieve the desired high moisture content in the coating when it reaches the gloss-calendering nip, it is necessary that only a minimum of the water in the coating be removed from the coating in the interval between the application of coating to the base stock and the contact of the coating surface with the gloss-calender roll. This is especially important in view of the fact that the coating formulations employed in the present invention contain a high percentage by weight of solids and thus a low weight-percentage of water.

More particularly, the aqueous paper coating compositions of the invention have a total solids content of from about 60 to 70% by weight. It is further important to the present invention that the binder be thermoplastic. This high solids, thermoplastically bound coating composition yields an unusually smooth surface after the coating operation which lends itself well to gloss-calendering. Further in accordance with the invention, it is necessary to prepare the fibrous substrate which is to be coated and gloss-calendered so that it resists the penetration of the coating formulation. This is accomplished by internally or externally sizing the base stock to fill the pores of the paper. In a preferred embodiment, external sizing is accomplished by applying a layer designated hereinafter as an "intermediate" or "intermediate impregnation" coating which is applied to the base stock and dried before application of the coating which is to be gloss-calendered, hereinafter designated as the "top" coating. The intermediate coating comprises a fine particle size pigment and a non-thermoplastic binder which serves as a sizing agent. The contributions of the moistness of the high-solids top coating, the thermoplasticity of the binder therein, and the barrier between the fibrous substrate and the top coating provided by the intermediate coating combine to permit the top coating to be molded effectively by the gloss-calender drum.

Figure 1:
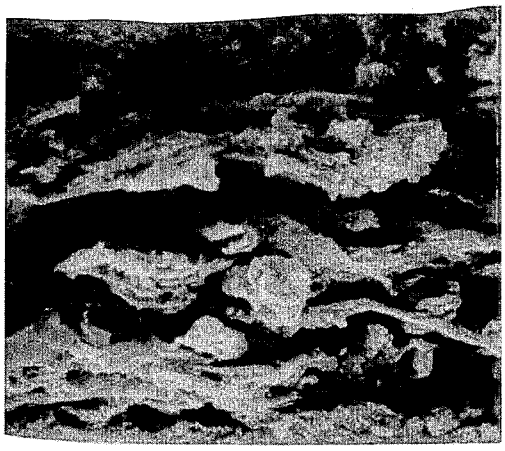
FIG. 1 is a cross-sectional photomicrograph of a sheet of paper prepared from a bodystock weighing about 85 grams per square meter which has a supercalendered high-quality, printing-grade coating on both sides weighing a total of approximately 35 grams per square meter.

In each case, the photographs were made on an electron-scanning microscope and the magnification is 800 times.

DETAILED DESCRIPTION OF THE INVENTION

The base stock or fibrous cellulosic substrate to be coated in accordance with the present invention can be one of a wide variety of types depending upon the use for which the product is intended. They can be internally sized or surface-sized stocks and can vary in weight from lightweight papers to the heavier paperboards. In order to achieve speeds of 1000 to 3000 ft./per minute, however, it is recommended that the weight of the paper base be greater than 30 grams per square meter. In order to obtain satisfactory gloss, i.e. greater than 50, the base sheet, before it receives the top coating, should retard rapid drainage of the water or of the coating into the fibrous substrate. This is accomplished by sizing the sheet, either internally or externally but preferably externally.

In a preferred embodiment, external sizing is included in an intermediate impregnation coating which serves as a base for the top coating.

This intermediate coating comprises a fine particle-size pigment and a non-thermoplastic binder, which also serves as size. More particularly, the particles of pigment are less than five microns in diameter and 90% of them are less than two microns. Suitable non-thermoplastic binders include the protein type such as casein, gelatin and soy protein; carbohydrate and polysaccharide types such as starch and vegetable gums; and synthetic types such as polyvinyl alcohol, methyl cellulose, carboxymethyl cellulose and styrene-maleic anhydride. The intermediate coating may further comprise, as a binder or size, the thermoplastic resins of the type employed in the top coating.

The top coating of the present invention comprises a paper-coating grade mineral pigment, a thermoplastic binder and an anti-sticking agent.

In the preferred embodiment, the pigment portion of the top coating comprises from 80 to 90% by weight of a glossing pigment. This glossing pigment can be a mixture of coating clay and other glossing pigments such as aluminum hydrate, precipitated calcium carbonate and titanium dioxide. The coating clay desirably comprises at least 60% of the total of the glossing pigments and preferably from 70 to 85%. Optimum gloss values are obtained by employing high-quality paper-coating clays wherein about 99% of the particles have an average particle diameter of under 2 microns. The remainder of the glossing pigment portion of the mixture of mineral pigments is selected from the other above-mentioned glossing pigments.

Representative clays for use in the present invention include Ultragloss 90 and Ultrawhite 90 sold by Engelhard Minerals & Chemicals Corporation, Edison, N.J. 08817; Hydragloss, Hydragloss 90, Hydratex, and Hydrafine sold by J. M. Huber Corporation, Menlo Park, N.J. 08837; and Nuclay, and Lustra Clay sold by Freeport Kaolin Company, a division of Freeport Sulphur Company, New York, N.Y. 10017.

Such clays are known in the art as predispersed clays and they are generally clays having adsorbed thereon sufficient polyphosphate to enable them to form deflocculated suspensions when mixed under shear with water. The use of predispersed clays, while convenient, is not necessary. Dispersing agents can be added to a non-predispersed clay prior to preparing the coating composition.

As previously stated, other glossing pigments can also be employed along with the paper coating clay. These include titanium dioxide and hydrated alumina. Hydrated alumina, commonly employed as an extender for titanium dioxide, has been found useful, even when titanium dioxide is not included, in enhancing the printing properties of the finished paper of the present invention. The aluminum hydrate is preferably employed in an amount equivalent to from about 5 to 10% by weight of the total pigment.

It is usually advantageous to include in the top coating a small quantity, i.e. up to about 20% of the total pigment weight, of non-glossing pigment having an average equivalent spherical diameter in excess of 2 microns. Suitable examples include ground natural barytes (barium sulfate). Preferred, however, is water-ground natural limestone (calcium carbonate). The brightness of the calcium carbonate pigment is excellent. This pigment conveniently has an equivalent spherical diameter of from 2 to 8 microns with a mean equivalent spherical diameter of about 3 microns. Compared to the dimension of the coating clay particles, which are on the average about 0.5 micron, the particles of calcium carbonate are relatively enormous. It may at first seem surprising to employ a non-glossing pigment in a glossy coating formulation, but it has been found that substantial amounts of a "dull" pigment such as water-ground calcium carbonate may be employed with virtually no loss of gloss.

The resinous binder component of the coating composition in accordance with the present invention is preferably used in latex form, i.e. microscopic particles of polymer suspended in a water vehicle by the air of emulsifying and/or stabilizing agents. Particularly preferred are the resins which exhibit primarily elastomeric properties, often described as the rubbery polymers, such as the copolymers styrene-butadiene and styrene-isoprene, or either of them slightly carboxylated by incorporation of from 3 to 10% acrylic acid. Suitable commercial examples are the latexes sold by Dow Chemical Company Nos. 612 and 620, the latter being carboxylated.

A synthetic thermoplastic latex binder is preferably employed as the sole binding agent since the use of natural, non-thermoplastic adhesives such as casein, soy protein and starch in an amount sufficient to contribute significant binding action results in a decrease in gloss. The addition to the binder of a minor proportion, i.e. up to 3 parts per hundred parts of pigment, of a non-thermoplastic adhesive in the coating composition, however, can be advantageous in that it may improve coater performance.

A variety of anti-sticking agents can be employed in the coating composition to prevent the wet surface of the coating from sticking to the hot surface of the gloss-calendering roll. Many anti-sticking or release agents are well known to those of ordinary skill in the art. The desirability of an anti-sticking agent for use in the present invention is measured by its effectiveness in preventing the wet surface of the coating from sticking to the surface of the hot gloss-calendering roll. Suitable examples of such agents include sulfonated castor oil and potassium oleate. The preferred anti-sticking agent comprises a mixture of predispersed calcium stearate and emulsified oleic acid.

When a mixture of predispersed calcium stearate and emulsified oleic acid is employed as the anti-sticking agent, the calcium stearate is employed in an amount equivalent to from 0.75 to 2.0 percent by weight (dry weight basis) of the total amount of pigment and the oleic acid is employed in an amount equivalent to from about 0.2 to 0.7 percent by weight of the total pigment. The oleic acid is emulsified so that it can be distributed throughout the coating and thus provide the desired release properties. When the amount of calcium stearate is increased above 2.0 percent, ink trapping may occur when the paper is printed and at levels materially below 0.75 percent, the coating layer sticks to the calender drum. When less than 0.2 percent of oleic acid is employed, a haze forms on the gloss-calender drum and the gloss of the coating is decreased significantly. On the other hand, the amount of oleic acid can be increased above 0.7 percent without detrimentally affecting the coating; however, such increased amounts of oleic acid do not appear to improve the release characteristics appreciably.

Other additives such as defoaming agents, dyes, insolubilizers, optical brighteners and the like can be added to the paper coating composition if desired. It has been found tht paper qualities such as "wet pick" and "wet rub" can be improved significantly by adding a melamine-formaldehyde insolubilizer, e.g. American Cyanamid's Parez 613 in an amount equivalent to from 1 to 2.5% based on the total weight of the pigments.

In carrying out the preferred method of the present invention, an intermediate coating is applied to each side of the web to be top coated, i.e., if only one side is to be top coated, only that side requires an intermediate coating but if both sides are to be top coated, an intermediate coating is applied to both sides of the web. The intermediate coating serves to prevent the water in the coating from soaking into the base stock too fast. Without an intermediate coating, too much of the moisture employed in the top coating may be absorbed by the base sheet, unless the latter is sufficiently sized, leaving the top coating too dry to be most effectively gloss-calendered. The top coating is applied over the dried intermediate coating, preferably by means of a flooded-nip blade-coater in an amount sufficient to provide a continuous, moldable surface, typically from 5.0 to 18 grams of top coating per square meter. Following the application of the top coat, within not more than five seconds, the coated web is conveyed to a gloss-calendering nip formed between a heated polished drum and a resilient backing roll.

One of the critical features of the present invention is that the uncalendered top coat, i.e., the paper coating composition applied by the blade, must contain enough moisture that in the absence of the anti-sticking agent the coating would stick to the surface of the gloss-calendering drum. Slight drying of the top coat between the flooded-nip blade-coater and the gloss-calender is tolerable, but the temperature of the coating should not be elevated substantially during the drying procedure. If the surface temperature of the coating is materially (i.e. more than 10° C) above 60° C the coating becomes too dry and the optimum gloss is not obtained. In one series of experiments, measurements of the total moisture contents of the coated paper immediately following the coating station and again just prior to the gloss-calendering nip indicated that the paper lost from 1.6 to about 23 percent of its total water content. When as much as 23 percent by weight was lost, there was a substantial decrease in gloss. Satisfactorily high gloss was obtained when the water loss was maintained below 10 percent. The water loss depends upon the time between coating and gloss-calendering and the amount of heat applied, if any. The moisture content of the treated web as it enters the gloss-calendering nip can be measured by means of a Beta-Ray gauge sold by Tracerlab, Waltham, Massachusetts or by an Infra-Mike sold by General Electric Company. Tests conducted utilizing various distances between the coater and gloss-calender and various web speeds have shown that a time interval of not over 5 seconds optimizes gloss. If the time period is too long, too much water drains from the top coating into the base stock and the top coating does not become glossy enough. Furthermore, if the coating is heated excessively, good gloss is not obtained. The reason for this is not fully understood; however, it is believed to be due in part to coalescence of the binder and the excessive drying due to evaporation of the coating water. It is important that the surface of the coating not be dried excessively because once the moisture content of the coating is reduced below an acceptable level, the coating cannot be rewet without extreme difficulty.

On the other hand, it is essential that a short interval of time, at least one second and preferably at least two, shall intervene between the time the web leaves the blade coater and the web surface comes into contact with the gloss-calender drum. It is believed that this interval permits migration of the anti-sticking agent to the surface of the coating to prevent adherence of the wet coating to the gloss-calender drum surface.

The surface temperature of the gloss-calendering drum is typically in the range of from 82° to 150° C with the preferred range being from 107° to 135° C; better gloss being obtained generally when the surface temperature of the gloss-calendering drum is near the upper limits. The pressure in the nip formed between the polished gloss-calendering drum and the resilient backing roll is generally maintained in the range of from 400 to 800 pounds per linear inch with pressures between 450 and 700 being preferred. As the web emerges from the gloss-calendering nip, it usually passes around a fly roll and preferably through at least one more gloss-calendering nip to enhance slightly the gloss imparted by the first gloss-calender.

The process of the present invention eliminates many of the deficiencies of the prior art processes. Among its advantages is high speed. Utilizing the process of the present invention, high-quality, glossy printing paper is readily produced at speeds between 1000 and 3000 feet per minute. The high bulk, gloss-calendered papers of the invention are useful as high-grade printing papers possessing uniform density and excellent opacity and brightness characteristics undiminished by the pressures of supercalendering. The glossy coatings exhibit excellent printing characteristics, with good ink hold-out and ink setting times.

Another advantage is that a glossy coating is achieved in accordance with the present invention using a significantly smaller amount of bodystock material than required for a high-quality supercalendered enamel coating having the same gloss characteristics and printing properties, since a lighter weight bodystock can be employed to produce a final coated product having the same thickness as a supercalendered enamel sheet prepared from a heavier bodystock. By way of example, FIG. 1 depicts a magnified cross-section of a sheet of high-quality supercalendered enamel paper prepared from a base stock weighing about 85 grams per square meter and having a coating weight of approximately 35 grams per square meter, producing a total weight of 120 grams per square meter, which corresponds to 80 pounds per ream (3300 square feet). The thickness (caliper) of the sheet shown in FIG. 1 is duplicated in accordance with the present invention by the sheet depicted in magnified cross-section in FIG. 2, which is prepared from a base stock weighing about 70 grams per square meter and has a coating weight of approximately 35 grams per meter, producing a total weight of 105 grams per square meter, which corresponds to 70 pounds per ream. More particularly, the thickness of four sheets of the paper depicted in FIG. 1 is 0.384 mm, whereas the thickness of four sheets of the paper depicted in FIG. 2 is 0.413 mm.

Figure 3:
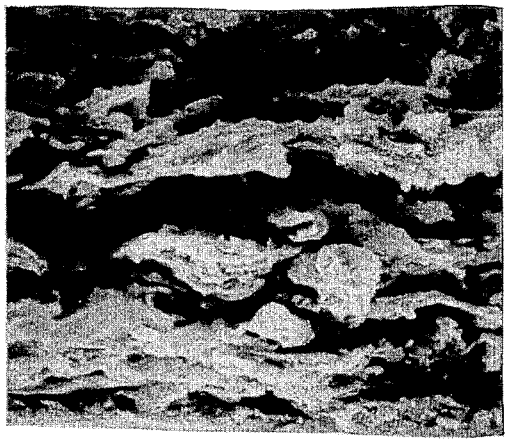
FIG. 3 is a cross-sectional photomicrograph of a sheet of paper identical to that depicted in FIG. 1.
Figure 4:
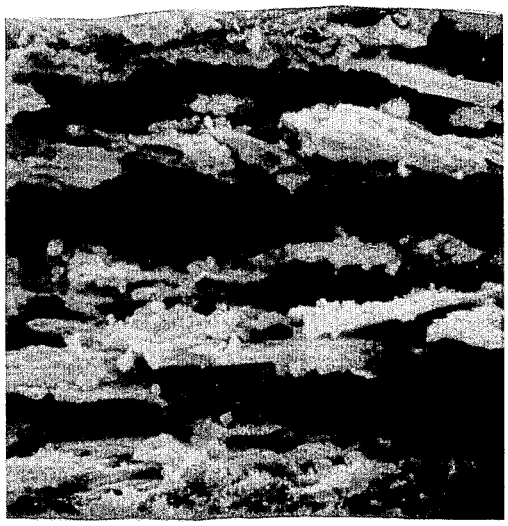
FIG. 4 is a cross-sectional photomicrograph of a sheet of paper prepared in accordance with the present invention from a bodystock weighing about 85 grams per square meter and having a total coating weight of approximately 35 grams per square meter.

Conversely, if a base stock of the same weight as illustrated in FIG. 1 is chosen, and a coating weight of 35 grams per square meter is applied in accordance with the present invention, then the thickness of the sheet, depicted in FIG. 4, is at least 20% greater than that of the supercalendered sheet shown in FIG. 1 and reproduced in FIG. 3. More particularly, the thickness of four sheets of the paper depicted in FIG. 4 is 0.475 mm, which is 24% greater than the thickness of four sheets of the paper depicted in FIG. 3.

Figure 2:
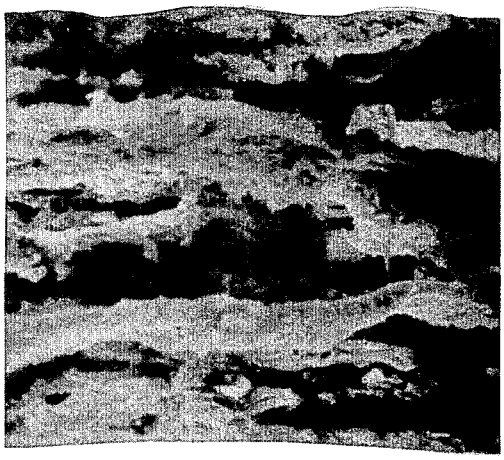
FIG. 2 is a cross-sectional photomicrograph of a sheet of paper prepared in accordance with the present invention from a bodystock weighing about 70 grams per square meter and having a total coating weight of approximately 35 grams per square meter.

FIGS. 2 and 4 also depict that a sheet of paper according to the invention is essentially devoid of the characteristic of substrate fibers penetrating into and being securely anchored within the film coating.

The capability of the process of the invention for providing a sheet of greater bulk (greater volume per unit of weight) offers several advantages. Not only are less materials required to produce a sheet of a given thickness, but postage or shipping costs, being based on weight, are also reduced. Starting with a base stock of a given weight, the present invention provides a coated sheet of greater thickness and better appearance. Practically speaking, this means that a user seeking greater bulk in a coated paper of a particular weight, by selecting paper of the same weight but produced in accordance with the present invention, gains the opacity and bulk characteristic of a heavier paper. Compare the papers shown in FIGS. 3 and 4. A user seeking savings in postage or shipping, by selecting a paper of the same thickness as one he is presently using but produced in accordance with the present invention, acquires a paper substantially lighter in weight. Compare the sheets shown in FIGS. 1 and 2.

The principles, features and advantages of the invention will be further understood upon consideration of the following specific examples.

EXAMPLE I

A paper stock weighing 79.5 grams per square meter, comprised of about 50 percent long fibers and 50 percent short fibers was internally sized with cationic starch (0.319 percent dry weight) and Aquapel 315 (0.173 percent dry weight), a product of Hercules Inc. which comprises a dimer of an alkyl ketene having six or more carbon atoms in its chain and which imparts water repellence to the web, and coated on each side by means of a size press with about 6 grams per square meter (dry weight) of an intermediate impregnation coating containing about 48 parts ethylated starch, 12 parts oxidized starch adhesive, 90 parts predispersed coating clay, 10 parts $TiO_2$, 0.15 part tetrasodiumpyrophosphate, 0.75 part anti-foaming agent, 0.1 part pentachlorophenol and 1 part dimethylolurea. The intermediate coat was then dried (total moisture content of intermediate coat and base stock about 4 percent moisture). The water penetration value of this coating was about 35 seconds.

The water penetration test is made by floating a small sheet of the paper to be tested on the surface of distilled water held at 20° C and lightly sprinkling finely powdered potassium permanganate on the sheet. The time in seconds is measured until purple discoloration is noted due to the dissolution of permanganate in water which has penetrated through the sheet.

The top coat was then applied to each side of the sized and impregnation-coated paper web by means of a flooded-nip trailing-blade coater. The top coating contained the following, parts given on a dry weight basis except where wet weight is indicated.

| Component | Parts |
|---|---|
| clay (Ultrawhite 90) | 80 |
| ground calcium carbonate | 15 |
| aluminum hydrate | 5 |
| styrene-butadiene-acrylic acid polymer (Dow-620) | 16 |
| melamine-formaldehyde insolubilizing agent (Parez 613) | 1.6 |

-continued

| Component | Parts |
|---|---|
| predispersed calcium stearate | 1.2 |
| oleic acid emulsion (300 grams $H_2O$, 226 grams oleic acid and 1 gram dispersing agent) | 1.15 (wet weight) |
| anti-foaming agent, 50% solids - (Siotol 505 Imperial Chemical Industries Ltd.) | 0.5 (wet weight) |
| water in an amount sufficient to produce a coating composition having 65% solids. | |

The top coat was applied to the first side of the paper web in an amount sufficient to provide 8.43 grams dry weight of coating per square meter. The coating was applied at a web speed of about 1500 feet per minute. Following the application of the top coating, it was dried slightly at ambient air temperatures.

The time required for the web to travel between the coater and the first gloss calendering nip was about 2.6 seconds. The moisture content of the paper was measured by means of two Beta-Ray gauges (supplied by Tracerlab - 1601 Trapelo Road, Waltham, Massachusetts 02154) one placed immediately after the coater and the other placed immediately in front of the gloss calender nip. The moisture content of the paper immediately before the gloss calender was 7.36 percent of the bone dry weight. Between the coating station and the calender, 23 percent of the water was lost. The coated sheet was passed through four successive gloss calender nips with fly rolls being used to guide the web between the nips. The calendering drum temperature was 110° C and the nip pressures were about 500 pounds per linear inch. This coating had a gloss of about 54 following the four nip gloss-calendering operation.

The other side of the same web was then coated with the same top coat formulation applied in an amount sufficient to provide 11.1 grams dry weight of coating per square meter. The coated web was then slightly dried under the same conditions employed in processing side 1. Beta-gauge measurements established the moisture content of the top-coated web at the gloss calender to be 10.44%. Between the coater and the calender, only 4.57 percent of the moisture was lost. The second top coat was finished on the same gloss-calender and under the same conditions as employed to finish the top coat on the first side and had a finished gloss of 65, thus demonstrating that minimizing the loss of water enhances gloss.

EXAMPLE II

Paper base stock which was internally sized with starch and Aquapel, and coated with an intermediate impregnation coating as in EX. I, and which (thus sized and coated) weighed 99 grams per square meter ($g/m^2$), was coated with the top coating described in EX. I. The first side was coated with sufficient coating to provide 10.72 $g/m^2$, dry weight. The coated sheet had a water content of 9.4 percent on a bone dry basis immediately before entering the first gloss-calender nip and had lost only 2.9 percent of the water between the coater and the calender. The gloss following the four calendering nips was 65. The second side of the base stock was coated with the same top coat in an amount equal to 11.2 $g/m^2$. This coated sheet lost 1.6 percent of the water and had a moisture content of 9.45 percent bone dry basis immediately before entering the first gloss-calender nip and a final gloss following the four calendering nips of 68. The calender temperatures and pressures in this operation were substantially the same as described in EX. I.

EXAMPLE III

An intermediate coated base which may be substituted for the bases used in Examples I and II with equally satisfactory results is made by omitting any internal sizing agent from the paper-making furnish and including the water-repellent Aquapel in the aqueous intermediate coating composition. An effective quantity of Aquapel is 2 to 3 parts, dry weight, to 100 parts of pigment in the intermediate coating. The formulation of this intermediate coating composition is as follows:

| Component | Parts dry Wgt. |
|---|---|
| predispersed coating clay | 90 |
| titanium dioxide | 10 |
| polyphosphate dispersing agent | .15 |
| defoamer | .75 |
| starch adhesive | 60 |
| dimethylolurea | 1 |
| Aquapel (in aqueous emulsion) | 2 |
| Water in an amount sufficient to produce a coating composition having 20% solids. | |

This coating applied in the amount of 6 $g/m^2$ dry weight to each side of an unsized paper web weighing about 80 grams per square meter and comprising about equal parts of short and long cellulosic fibers together with up to 10% by weight of mineral filler, results in a sheet having a water penetration value of about 15.

EXAMPLE IV

The intermediate coated bodystock of Example III was coated on each side by means of a flooded-nip, trailing-blade coater with the following top coat in an amount sufficient to give 11 $g/m^2$, dry weight.

| Component | Parts dry Wgt. |
|---|---|
| clay (Ultrawhite 90 | 80 |
| ground calcium carbonate | 10 |
| titanium dioxide | 10 |
| poly(vinyl acetate)latex | 18 |
| (No. 206 H.B. Fuller Co., St. Paul, Minn.) | 18 |
| soy protein | 1 |
| melamine-formaldehyde insolubilizing agent (Parez 613) | 1.6 |
| enzyme converted starch | 0.5 |
| predispersed calcium stearate | 1.2 |
| oleic acid emulsion at 44% solids | 0.73 |
| defoamer - Siotol 505 | 0.25 |
| ammonium hydroxide, conc. | 0.16 |
| Water in amount sufficient to produce a coating composition having 65.6% by weight solids. | |

The processing conditions were substantially the same as in EX. II. The gloss on one side of the sheet was 53 and on the other side of the sheet was 54.

EXAMPLE V

The intermediate coated web of Example III was coated on each side by means of a flooded-nip, trailing-blade coater with a formulation comprising:

| Component | Parts dry Wgt. |
|---|---|
| clay (Ultrawhite 90) | 80 |
| ground calcium carbonate | 10 |
| titanium dioxide | 10 |
| styrene-butadiene-acrylic acid polymer (Dow 620) | 18 |
| Aquapel 421 emulsion | 1 |
| soy protein | 1 |
| enzyme converted starch | 0.5 |
| melamine-formaldehyde insolubilizing agent (Parez 613) | 1.6 |
| predispersed calcium stearate | 1.2 |
| oleic acid emulsion 44% | 0.73 |
| defoamer - Siotol 505 | 0.25 |
| ammonium hydroxide, conc. | 0.16 |
| Water in an amount sufficient to produce a coating composition having 64% by weight solids. | |

To each side of the intermediate coated sheet was applied an amount of the top coating composition which produced a dried coating weight of 11 g/m². The processing conditions were substantially the same as in Example II. The gloss on each side was approximately 55.

EXAMPLE VI

The intermediate coated bodystock of Example III was coated on each side by means of a flooded-nip, trailing-blade coater with a formulation comprising:

| Component | Parts dry Wgt. |
|---|---|
| clay (Ultrawhite 90) | 80 |
| ground calcium carbonate | 10 |
| titanium dioxide | 10 |
| Rhoplex B-15 (an acrylic resin emulsion sold by Rohm & Haas Company) | 18 |
| soy protein | 1 |
| enzyme converted starch | 0.5 |
| melamine-formaldehyde insolubilizing agent (Parez 613) | 1.6 |
| predispersed calcium stearate | 1.2 |
| oleic acid emulsion 44% | 0.73 |
| defoamer - Siotol 505 | 0.25 |
| ammonium hydroxide, conc. | 0.2 |
| Water in an amount sufficient to produce a coating composition having 61.3% by weight solids. | |

To each side of the intermediate coated sheet was applied an amount of the top coating composition which produced a dried coating weight of 11 g/m².

The top coating composition was applied at a web speed of 1400 feet per minute. It was dried slightly with air for about one-third second. The elapsed time between the coater and the first gloss calendering nip was about 3 seconds.

The coated sheet was passed through four successive gloss-calender nips with fly rolls being used to guide the web between the nips. The calendering drum temperature was 150° C. and the nip pressure 500 pounds per linear inch. The other side of the web was then coated with a similar amount of the same top-coat formulation and calendered under the same conditions. The gloss on each side was approximately 52.

EXAMPLE VII

Paper base stock weighing 99 grams per square meter and internally sized with starch and Aquapel was coated on both sides in an amount equal to 6 g/m² per side dry weight with the following intermediate coating composition:

| Component | Parts dry Wgt. |
|---|---|
| clay (Ultrawhite 90) | 100 |
| polyvinyl alcohol | 34 |
| butanol | 1.6 |
| tetrasodiumpyrophosphate | 0.17 |
| wetting agent - Union Carbide's Tergitol NPX | 1.0 |
| tributyl phosphate | 1.0 |
| Water in an amount sufficient to produce a coating composition having 14% solids. | |

This intermediate coated web after drying to 4% moisture was subsequently top coated on each side and gloss-calendered under the conditions of Example II. The gloass of the resulting gloss-calendered paper was greater than 60 on each side.

EXAMPLE VIII

A sheet of magazine grade, weighing 36 g/m² composed of all long fibers, sized with rosin and alum, and having a water penetration value of 2 seconds was coated on each side by means of a flooded-nip, trailing-blade coater with 9 g/m² dry weight of the following composition:

| Component | Parts dry Wgt. |
|---|---|
| clay (Ultrawhite 90) | 80 |
| ground calcium carbonate | 15 |
| aluminum hydrate | 5 |
| styrene-butadiene-acrylic acid polymer (Dow 620) | 16 |
| melamine-formaldehyde insolubilizing agent (Parez 613) | 1.6 |
| predispersed calcium stearate | 1.2 |
| oleic acid emulsion at 44% solids | 0.73 |
| defoamer - Siotol 505 | 0.25 |
| Water in an amount sufficient to produce a coating composition having 65% solids. | |

The web thus coated was gloss-calendered according to the conditions of Example II and yielded a finished web which had a gloss of 50 on one side and 51 on the other side.

EXAMPLE IX

A paper stock comparable to that employed in EX. I, except that the fibers were substantially all long fibers, was coated on each side with 2 grams per square meter (dry weight) of ethylated starch and dried.

To each side of the starch-sized paper web was applied by means of a flooded-nip, trailing blade coater in an amount sufficient to provide 11.5g/m² (dry weight) a top coating formulation containing only glossing pigments which comprised:

| Component | Parts dry weight |
|---|---|
| clay (Ultrawhite 90) | 55.0 |

-continued

| Component | Parts dry weight |
|---|---|
| aluminum hydrate | 30.0 |
| titanium dioxide | 15.0 |
| styrene-butadiene-acrylic acid polymer (Dow 620) | 20.0 |
| melamine-formaldehyde insolubilizing agent (Parez 613) | 1.6 |
| predispersed calcium stearate | 1.2 |
| oleic acid emulsion | 0.6 |
| anti-foaming agent | 0.25 |
| Water in an amount sufficient to produce a coating composition having 62% solids. | |

The coated web was gloss-calendered under conditions substantially the same as in EX. II except that only two calendering nips were employed. The gloss on each side of the sheet was greater than 55.

While the invention has been particularly shown and described with reference to preferred embodiments thereof, it is understood that various other changes and modifications thereof will occur to a person skilled in the art without departing from the spirit and scope of the invention as defined by the appended claims.

What is claimed is:

1. A method for the preparation of a uniformly, densely coated paper substrate displaying excellent ink holdout properties, characterized by high bulk, increased brightness and opacity, and a gloss value of at least 50, which method essentially consists of:

i. applying a coating of an aqueous top coating composition to at least one surface of a given fibrous cellulosic substrate;

ii. said fibrous cellulosic substrate having been prepared to resist penetration of the said aqueous top coating composition;

iii. said aqueous top coating composition having a total solids content of at least about 60 percent by weight, and said solids content thereof comprising a major proportion of a paper-coating grade pigment, a minor proportion of a thermoplastic binder and a minor amount of an anti-sticking agent; thence iv. gloss-calendering, temporarily plasticizing and molding said coated substrate by conveying same through a nip formed between a heated polished drum and a resilient backing roll to at least partially coalesce the thermoplastic binder content of the said aqueous top coating composition;

v. the temperature of said heated polished drum ranging from between about 82° to 150° C. and the pressure exerted on said coated substrate in said nip ranging from between about 400 to 800 pounds per lineal inch;

vi. the amount of water loss from the said top coating in that time interval between the application (i) thereof and the gloss-calendering and molding operation (iv) being less than that amount such as would effect substantial decrease in resultant high gloss;

vii. the temperature of the said coated substrate not being elevated to a value substantially above about 60° C. in the said time interval between the application (i) and the gloss-calendering and molding operation (iv);

viii. concomitantly, the water content of the said top coating, at the point of entry of the said coated substrate into the said nip, is such that, in the absence of the said minor proportion of anti-sticking agent, the substrate coating would stick to the surface of the said gloss-calendering, heated polished drum; and ix. removing the thus coated and gloss-calendered fibrous cellulosic substrate from contact with the said heated polished drum and resilient backing roll as same emerges from the said nip formed therebetween;

x. whereby there is recovered a smooth, molded, polished, high gloss fibrous cellulosic substrate having the high bulk and density characteristics of lightly machine-calendered paper, albeit its said coating is itself dense, uniform and provides excellent ink holdout.

2. The method as defined by claim 1, wherein the time interval between the said application (i) and the said gloss-calendering (iv) does not exceed about 5 seconds.

3. The method as defined by claim 2, wherein the said method is conducted at speeds of from about 1,000 to 3,000 feet per minute.

4. The method as defined by claim 1, wherein the preparation (ii) is by internally or externally sizing the base stock comprising the given fibrous cellulosic substrate.

5. The method as defined by claim 4, wherein the said base stock is externally sized by applying to at least one face surface thereof, an intermediate coating composition comprising a paper-coating grade pigment, the particle size thereof being less than about 5 microns, and a non-thermoplastic binder therefor, and thence drying said intermediate coating.

6. The method as defined by claim 1, wherein the weight of the said given fibrous cellulosic substrate is greater than 30 grams per square meter.

7. The method as defined by claim 1, wherein the said aqueous top coating composition (iii) has a total solids content of from 60 to 70 percent by weight.

8. The method as defined by claim 1, wherein the temperature of said heated polished drum ranges from between about 107° to 135° C. and the pressure exerted on said coated substrate in said nip ranges from between about 450 to 700 pounds per lineal inch.

9. The method as defined by claim 1, wherein the amount of top coating composition applied ranges from between about 5.0 to 18 grams per square meter of said fibrous cellulosic substrate.

10. The method as defined by claim 1, wherein the amount of water loss (vi) from the said top coating is less than about 23 percent by weight.

11. The method as defined by claim 10, wherein the amount of water loss (vi) from the said top coating does not exceed about 10 percent by weight.

12. The method as defined by claim 1, wherein the paper-coating grade pigment comprising the aqueous top coating composition (iii), comprises from about 10 to 90 percent by weight of a glossing pigment.

13. The method as defined by claim 12, wherein the said glossing pigment comprises a mixture of coating clay and a member selected from the group consisting of aluminum hydrate, precipitated calcium carbonate, titanium dioxide and admixtures thereof.

14. The method as defined by claim 13, wherein the coating clay comprises at least about 60 percent by weight of the total glossing pigment.

15. The method as defined by claim 12, wherein the paper-coating grade pigment comprising the aqueous top coating composition (iii) comprises up to about 20 percent by weight of a non-glossing pigment having an average equivalent spherical diameter in excess of about 2 microns.

16. The method as defined by claim 1, wherein the thermoplastic binder comprising the aqueous top coating composition (iii) comprises an elastomeric latex.

17. The method as defined by claim 16, wherein the thermoplastic latex binder comprises a minor proportion of a non-thermoplastic adhesive.

18. The method as defined by claim 1, wherein the anti-sticking agent comprising the aqueous top coating composition (iii), comprises a member selected from the group consisting of sulfonated castor oil, potassium oleate, and a mixture of predispersed calcium stearate and emulsified oleic acid.

19. The method as defined by claim 18, wherein the anti-sticking agent comprises the mixture of predispersed calcium stearate and emulsified oleic acid.

20. The method as defined by claim 1, wherein the aqueous top coating composition (iii) further comprises a member selected from the group consisting of a defoaming agent, a dye, an insolubilizer, an optical brightener and mixtures thereof.

21. The method as defined by claim 1, further comprising passing the thus coated and gloss calendered substrate through at least one more gloss-calendering nip.

22. A smooth, molded, polished, uniformly densely coated paper substrate displaying excellent ink holdout properties, said coated substrate consisting essentially of a coated article of:

i. a sized, fibrous cellulosic substrate having a weight greater than about 30 grams per square meter, said substrate bearing on at least one face surface thereof;

ii. a smooth, molded, uniformly dense, high gloss coating having increased brightness, opacity and a gloss value of at least 50, said coating comprising a major proportion of a paper-coating grade pigment, a minor proportion of an at least partially coalesced thermoplastic binder and a minor amount of an anti-sticking agent;

iii. said coated article displaying the high bulk and density characteristics of lightly machine-calendered paper, with the said coating (ii) comprising the same being itself dense and uniform; and iv. whereby the total amount of bodystock material comprising the said fibrous cellulosic substrate (i) is significantly lighter in weight than that amount required for a high-quality supercalendered enamel coated substrate having comparable gloss characteristics and printing properties, as respectively illustrated in the FIGS. 1 to 4 of the drawing.

23. The coated paper substrate as defined by claim 22, wherein the said fibrous cellulosic substrate (i) bears a high gloss coating (ii) at both face surfaces thereof.

24. The coated paper substrate, as defined by claim 22, wherein the said fibrous cellulosic substrate (i) is externally sized by means of an intermediate interlayer comprising a paper-coated grade pigment, the particle sizes thereof being less than about 5 microns, and a non-thermoplastic binder thereof.

* * * * *